US005535712A

United States Patent [19]

Matsubara et al.

[11] Patent Number: 5,535,712

[45] Date of Patent: Jul. 16, 1996

[54] DEVICE FOR CONTROLLING AN ENGINE

[75] Inventors: Morihiko Matsubara; Toshio Kuwabara; Shuji Okano, all of Tokyo, Japan

[73] Assignee: Shin Caterpillar Mitsubishi Ltd., Tokyo, Japan

[21] Appl. No.: 348,137

[22] Filed: Nov. 23, 1994

[30] Foreign Application Priority Data

Dec. 16, 1993 [JP] Japan ..... 5-067132 U

[51] Int. Cl.[6] ..... F02N 17/00; F02D 31/00

[52] U.S. Cl. ..... 123/179.4; 123/198 DB; 123/357

[58] Field of Search ..... 123/357, 358, 123/359, 179.17, 198 DB, 179.4, 179.7

[56] References Cited

U.S. PATENT DOCUMENTS

| | | | |
|---|---|---|---|
| 4,387,679 | 6/1983 | Folger | 123/198 DB |
| 4,452,196 | 6/1984 | Indra | 123/198 DB |
| 4,509,480 | 4/1985 | Kull | 123/198 DB |
| 4,823,751 | 4/1989 | Pfalzgraf | 123/198 DB |
| 4,924,827 | 5/1990 | Minegishi | 123/198 DB |
| 5,062,400 | 11/1991 | Minegishi | 123/198 DB |
| 5,072,702 | 12/1991 | Sasaki | 123/198 DB |
| 5,317,998 | 6/1994 | Hanson | 123/179.4 |

*Primary Examiner*—Carl S. Miller
*Attorney, Agent, or Firm*—Antonelli, Terry, Stout & Kraus

[57] ABSTRACT

A device for controlling an engine includes a main control unit for outputting a control signal in response to a signal from an accelerator dial, and a sub-control unit for controlling an actuator that actuates a control lever of a fuel feeding device in response to a control signal from the main control unit and a signal from a key switch. The sub-control unit controls the actuator in response to an off signal from the key switch so that the control lever is moved to a fuel stop position and, after the operation of the engine has been halted, controls the actuator so that the control lever is moved to a start position.

3 Claims, 3 Drawing Sheets

DEVICE FOR CONTROLLING AN ENGINE

FIELD OF THE INVENTION

The present invention relates to a device for controlling an engine and, particularly, to a device for controlling an engine mounted on a construction machine and the like machine.

DESCRIPTION OF THE PRIOR ART

FIG. 3 illustrates a conventional device for controlling an engine mounted on a construction machine and the like machine, wherein reference numeral 2 denotes an engine, and 4 denotes a fuel injection pump for feeding fuel to the engine 2. The amount of the fuel fed to the engine is determined depending upon the operation position of a control lever 6. The control lever 6 of the fuel injection pump is actuated by an actuator 14 which includes an electric motor 8, a reduction gear 10, an output lever 12, etc. The actuator 14 is controlled for its operation by a controller 16 which comprises a control unit 18 and a drive circuit 20. The control unit 18 outputs a control signal in response to a signal from an accelerator dial 22, a signal from a key switch 24 and a signal from a lever position sensor 26 that is mounted on the actuator 14 and detects the operation position of the control lever 6. The drive circuit 20 supplies electric power to the actuator 14 in response to the control signal from the control unit 18.

With the thus constituted device for controlling an engine, the key switch 24 is turned on at the time of starting the engine, and the accelerator dial 22 is manipulated and set to any position. Thereby, in response to a set position signal and a signal from the lever position sensor 26, the control unit 18 outputs a control signal to the drive circuit 20 which drives the electric motor 8, and the control lever 6 of the fuel injection pump is moved to a position that corresponds to the position to where the accelerator dial 22 is set. Then, the accelerator dial 22 is manipulated toward the direction of acceleration or deceleration, and the control lever 6 is operated between a low idling position L1 and a high idling position L2 in response to the manipulated position, thereby to adjust the speed of revolution of the engine. Next, to stop the engine, the key switch 24 is turned off. Thereby, the control unit 18 outputs the deceleration signal irrespective of the position to where the accelerator dial 22 is set, and the control lever 6 is moved to a fuel stop position L0 while a confirming signal is sent from the lever position sensor 26. Thus, fuel is no longer fed to the engine 2; i.e., the engine is brought into a halt.

Here, however, the controller 16 equipped with the control unit 18 is not only controlling the actuator 14 that actuates the control lever 6 of the fuel injection pump but also is controlling other systems such as a hydraulic pump, a control valve in a hydraulic circuit, an illumination circuit, a wiper blade driving circuit and the like circuits, and hence, is subject at a high probability to experiencing trouble. When the controller 16 malfunctions, it becomes difficult to control the engine. When trouble with the controller 16 arises during the operation of the engine, in particular, the engine may not be able to be brought into a halt, which is undesirable from the standpoint of safety. When the controller breaks down after the halt of the engine, the control lever 6 of the fuel injection pump cannot be moved from the fuel stop position L0; i.e., the engine cannot be started and the construction machinery is brought to a standstill at the site.

SUMMARY OF THE INVENTION

The principal object of the present invention is to provide a device for controlling an engine which is capable of bringing the engine to a halt by turning the key switch off even in the case in which the controller gets out of order during operation of the engine, and which is capable of starting the engine even when the controller malfunctions after the halt of the engine.

In order to accomplish the above-mentioned principal object according to the present invention, there is provided a device for controlling an engine, which comprises a main control means for outputting a control signal in response to a signal from an accelerator dial, and a sub-control means for controlling an actuator that actuates a control lever of a fuel feeding means which feeds fuel to the engine in response to a control signal from said main control means and a signal from a key switch, and in which said sub-control means controls said actuator in response to an off signal from said key switch so that said control lever is moved to a fuel stop position and, after the operation of the engine has been halted, controls said actuator so that said control lever is moved to a start position.

In the device for controlling an engine according to the present invention, the main control means, during ordinary operation, outputs an acceleration signal, a deceleration signal or a stop signal to the sub-control means in response to a signal from the accelerator dial and a signal from the control lever position sensor, and the sub-control means outputs a control signal to the drive circuit in response to a control signal from the main control means, whereby a forward/reverse electric motor that constitutes the actuator is driven and the control lever of the fuel injection pump is moved to a position that corresponds to the position to which the accelerator dial is manipulated. Then, to stop the engine, the key switch is turned off, whereby the sub-control means controls the forward/reverse electric motor of the actuator so that the control lever is moved to the fuel stop position and, after the operation of the engine has been halted, controls the forward/reverse electric motor of the actuator so that the control lever is moved from the fuel stop position to the start position.

DETAILED DESCRIPTION OF THE PREFERRED EMBODIMENTS

A device for controlling an engine constituted according to an embodiment of the present invention will now be described in detail with reference to the accompanying drawings.

Figure 1:
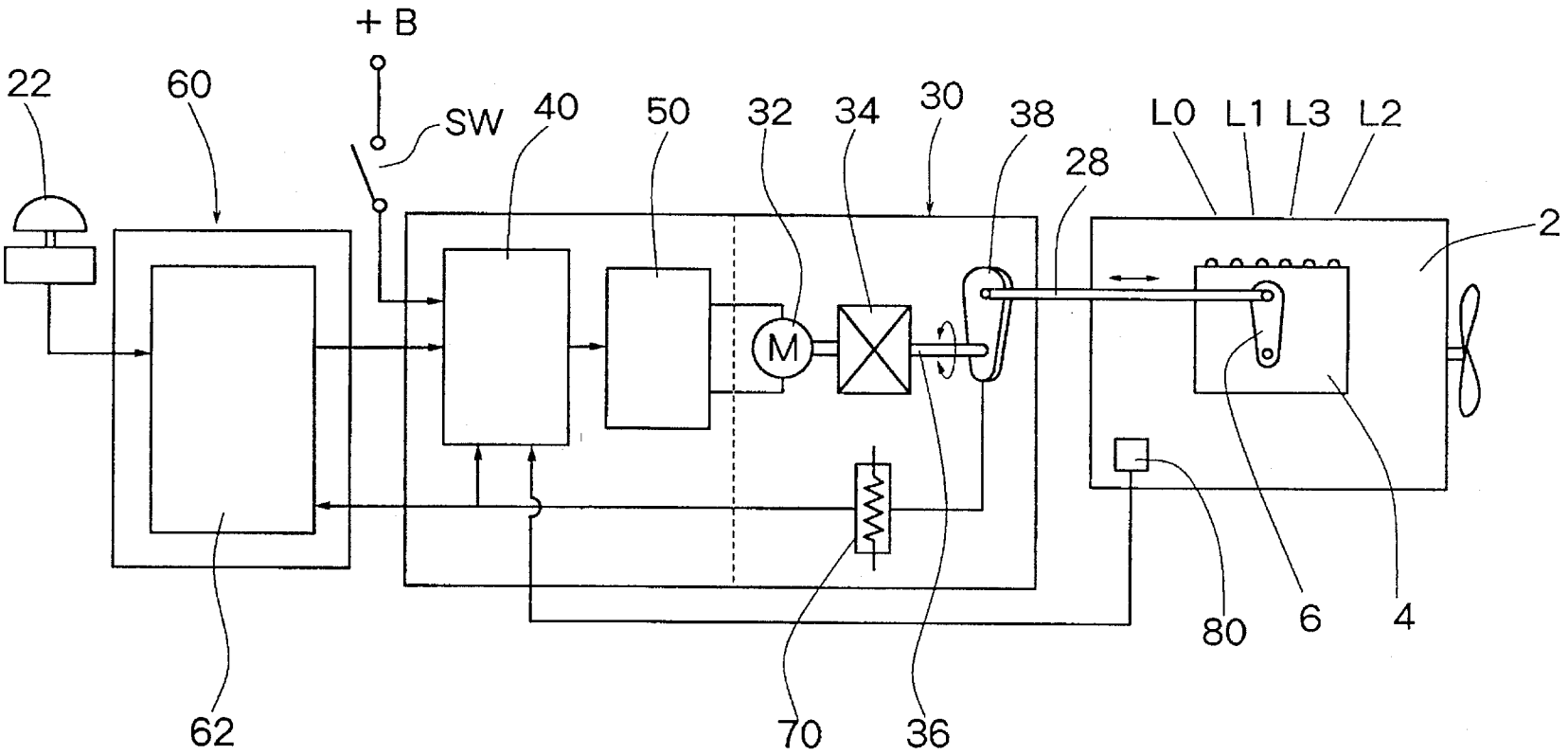
FIG. 1 is a block diagram of a device for controlling an engine constituted according to the present invention.

Referring to FIG. 1, which illustrates a device for controlling an engine constituted according to an embodiment of the present invention, reference numeral 2 denotes a diesel engine, and 4 denotes a fuel injection pump which is a fuel feeding means for feeding fuel to the engine 2. The amount of fuel fed to the engine 2 is determined depending upon the position to which a control lever 6 is moved. The control lever 6 of the fuel injection pump 4 is controlled to move by an actuator 30 between a low idling position L1 and a high idling position L2 and to a fuel stop position L0 and a start position L3.

The actuator 30 comprises a forward/reverse electric motor 32, a reduction gear 34 coupled to the output shaft of the motor 32, a rotary shaft 36 coupled to the reduction gear 34, and an output lever 38 which is coupled at its one end to the rotary shaft 36 and at its other end to a link 28 that is coupled to the control lever 6. The thus constituted actuator 30 is served with the drive electric power from a drive circuit 50 that is controlled by a sub-control means 40.

The sub-control means 40 outputs to the drive circuit 50 a control signal in accordance with a control program that is contained therein and in response to a signal from a main control means 62 that constitutes a controller 60 and which is made up of a microcomputer and will be described later, a signal from a control lever position sensor 70, a signal from an engine revolution sensor 80, a signal from a key switch SW and like signals.

The main control means 62 is made up of a microcomputer and outputs a control signal such as an acceleration signal, a deceleration signal or a stop signal to the sub-control means 40 in accordance with a control program contained therein and in response to a signal from a dial accelerator made up of a potentiometer, a rotary switch and the like, a signal from the control lever position sensor 70 and like signals.

The control lever position sensor 70 is constituted by a potentiometer, detects the operation position of the control lever 6 through the rotational position of the rotary shaft 36 of the actuator 30 that operates correspondingly thereto, and outputs a detection signal to the main control means 62 and to the sub-control means 40. The engine revolution sensor 80 is disposed, for example, being opposed to the engine flywheel, to detect the speed of revolution of the engine, and outputs the detection signal to the sub-control means 40. In the illustrated embodiment, the sub-control means 40, the drive circuit 50 and the control lever position sensor 70 are mounted on the actuator 30.

Next, described below is the operation of the device for controlling an engine that is constituted according to the embodiment as described above.

The main control means 62 receives a signal from the accelerator dial 22 and a signal from the control lever position sensor 70, judges whether it is necessary to provide acceleration or deceleration, or whether both signals are in agreement, based upon the manipulated position of the accelerator dial 22 and the position to which the control lever 6 is moved, and outputs a control signal to the sub-control means When the key switch SW is turned on, the sub-control means 40 inputs a control signal from the main control means 62, and outputs, as a control signal to the drive circuit 50, a forward rotation signal in the case of acceleration, a reverse rotation signal in the case of deceleration, or a stop rotation signal when the manipulated position of the accelerator dial 22 is in agreement with the position to which the control lever 6 is moved.

In response to a control signal from the sub-control means 40, the drive circuit 50 supplies electric power to the forward/reverse electric motor 32 of the actuator 30 or stops supplying the electric power. With the forward/reverse electric motor 32 of the actuator 30 being controlled as described above, the control lever 6 is moved to a position corresponding to the manipulated position of the accelerator dial 22 between the low idling position L1 and the high idling position L2, and fuel of an amount corresponding to the operation position is fed from the fuel injection pump 4 to the engine 2.

Figure 2:
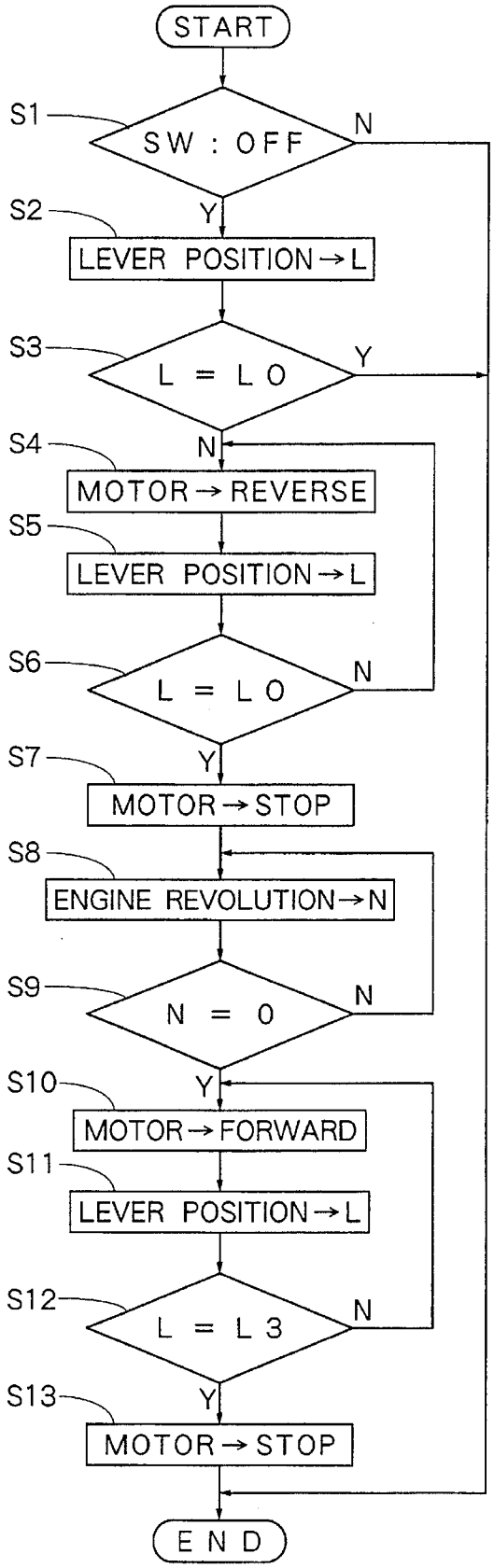
FIG. 2 is a flow chart illustrating the operation of a sub-control means that constitutes the device for controlling an engine of FIG. 1.
Figure 3:
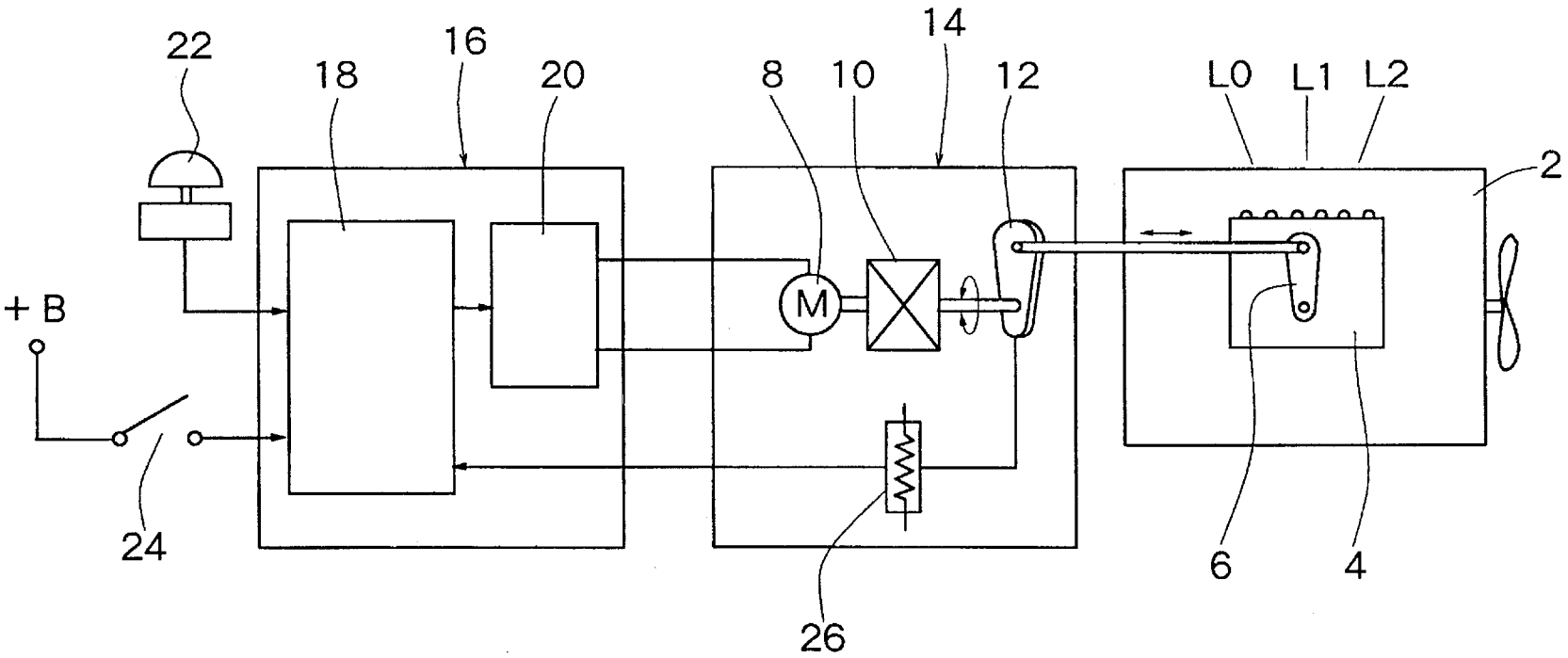
Fig. 3 (PRIOR ART)
FIG. 3 is a block diagram of a device for controlling an engine that has been conventionally used.

Next, described below with reference to the flow chart of FIG. 2, is the operation of the sub-control means 40 by which the operation of the engine 2 is brought to a halt.

In the sub-control means 40, when it is confirmed that the key switch SW is turned off (step S1), the program proceeds to a step S2 to read a detection signal L from the control lever position sensor 70. Then, it is checked at a step $3 whether the control lever position L is equal to the fuel stop position L0 or not. When the control lever position L is equal to the fuel stop position L0 at the step S3, no fuel has been fed; i.e., the engine 2 has been halted already and there is no need of executing the operation to stop the engine. Therefore, the program is finished. When the control lever position L is not equal to the fuel stop position L0 at the step S3, the engine is in operation. In order to stop the engine, therefore, the forward/reverse electric motor 32 of the actuator 30 is driven in the reverse direction (step S4). When the electric motor 32 is reversely driven, the sub-control means 40 proceeds to a step S5 to read the detection signal L from the control lever position sensor 70. At a step S6, it is checked whether the control lever position L is equal to the fuel stop position L0 or not. When the control lever position L is not equal to the fuel stop position L0, the control lever 6 is still not at the fuel stop position L0. Therefore, the operations of from step S4 to step S6 are repeated. When the control lever position L becomes equal to the fuel stop position L0 at the step S6, the electric motor 32 is no longer driven (step S7), an engine revolution signal N is read out from the engine revolution sensor 80 (step S8), and it is confirmed whether the engine revolution N has become zero (0) or not (step S9). This is to make sure that the revolution due to the force of inertia has reliably come into a halt, since the engine is revolving due to the force of inertia even after the control lever position L has moved to the fuel stop position L0 to stop the supply of fuel to the engine 2. When the engine revolution N is not still zero (0) at the step S9, the engine revolution N is waited for until it becomes zero (0). When it is confirmed that the engine revolution N became zero (0), the sub-control means 40 drives the forward/reverse motor 32 in the forward direction (step S10). When the motor 32 is driven in the forward direction, the sub-control means 40 proceeds to the step S11 to read a detection signal L from the control lever position sensor 70. It is then checked at a step S12 whether the control lever position L is equal to the start position L3 or not. When the control lever position L is not equal to the start position L3 at the step S12, the control lever 6 has still not arrived at the start position L3. Therefore, the operations of from step S10 to step S12 are repeated. When the control lever position L becomes equal to the start position L3 at the step S12, the electric motor 32 is no longer driven (step S13), and the program is finished.

As indicated in FIG. 2, so long as Step S1 determines that the key switch SW is not turned off, the program of steps S2–S13 is not performed.

According to the illustrated embodiment mentioned above, when the key switch SW is turned off, the sub-control means 40 works to reversely drive the electric motor 32 of the actuator in order to move the control lever 6 of the fuel injection pump 4 to the fuel stop position L0 irrespective of the control signal from the main control means 62. Therefore, the engine 2 can be reliably brought to a halt even in the case in which the main control means 62 gets out of order. When the engine is to be stopped, the sub-control means 40 works to move the control lever 6 to the fuel stop position L0 to reliably bring the engine to a halt and thereafter works to forwardly drive the electric motor 32 of the actuator 30 so that the control lever 6 is brought to the start position L3. Therefore, even in the case in which the main control means 62 is out of order at the time of starting the engine again, fuel is supplied, by cranking, in an amount necessary for starting the engine; i.e., it is allowed to start the engine. The illustrated embodiment has employed an engine revolution sensor 80 as a means for making sure that the revolution of the engine has become zero (0). It is, however, also allowable to make sure of the halt of the engine revolution by providing a timer to count a predetermined period of time after the control lever 6 of the fuel injection pump 4 is moved to the fuel stop position L0.

As described above, the device for controlling an engine according to the present invention comprises a main control means for outputting a control signal in response to a signal from an accelerator dial, and a sub-control means for controlling an actuator that actuates a control lever of a fuel feeding means in response to a control signal from said main control means and a signal from a key switch, and said sub-control means controls said actuator in response to an off signal from said key switch to move said control lever to the fuel stop position and, after the operation of the engine has been halted, controls said actuator to move said control lever to the start position. Therefore, even in the case in which the main control means gets out of order, the engine can be reliably brought to a halt by the sub-control means. This makes it possible to solve the problem in which the engine cannot be stopped due to trouble in the main control means during construction operations using a vehicle of construction machine. When the engine is to be stopped, furthermore, the sub-control means works to move the control lever to the fuel stop position to reliably bring the engine to a halt and, thereafter, works to move the control lever to the start position. Therefore, even in the case in which the main control means get out of order after the engine has been stopped, fuel can be supplied, by cranking, in an amount necessary for starting the engine; i.e., the engine can be started and the machine can be moved. Since the control lever is moved to the start position after the engine has been brought to a halt, the engine can be started again even in case the battery power, which is the power source, is lowered, and, besides, the cranking can be shortened by a period of time in which the control lever is moved from the fuel stop position to the start position. In assembling the machine at a production plant, furthermore, the controller is usually mounted at the final stage. Without the controller being mounted, the engine can be neither started nor stopped. According to the present invention, however, the sub-control means is mounted on the actuator, making it possible to start and stop the engine as mentioned above and, hence, possible to check the operation of the engine and the hydraulic systems, enabling the production efficiency to be enhanced.

What we claim is:

1. A device for controlling an engine of an engine-powered apparatus, wherein the engine has a key switch and a fuel feeding unit, the fuel feeding unit having a fuel-feed control lever movable between a first lever position in which the fuel feeding unit stops feeding of fuel to the engine, a second lever position in which the fuel feeding unit feeds fuel to the engine at a low-engine-speed feed rate, a third lever position in which the fuel feeding unit feeds fuel to the engine at a high-engine-speed feed rate, and a fourth lever position, between the second lever position and the third lever position, in which the fuel feeding unit feeds fuel to the engine at a feed rate for starting operation of the engine, and wherein the apparatus has an accelerator dial for indicating a desired fuel feed rate, said device comprising:

main control means for outputting a control signal in response to a signal from the accelerator dial, an actuator, including a reversible electric motor for moving the fuel-feed control lever, and sub-control means for controlling said actuator in response to a control signal from said main control means and a signal from the key switch, said sub-control means including means responsive to an off signal from said key switch when the control lever is not in the first lever position for controlling said actuator to cause said reversible electric motor to move said fuel-feed control lever in a first direction to the first lever position to stop feeding of fuel to the engine and, after the operation of the engine has been halted, to move said fuel-feed control lever in a second direction, opposite the first direction, to the fourth lever position to permit the engine to be started.

2. A device for controlling an engine according to claim 1, wherein said sub-control means is mounted on said actuator.

3. A device for controlling an engine according to claim 1, wherein said actuator further includes a reduction gear and an output lever for coupling said reversible electric motor to the fuel-feed control lever.

* * * * *